US006998726B2

(12) United States Patent
Sarlioglu et al.

(10) Patent No.: US 6,998,726 B2
(45) Date of Patent: Feb. 14, 2006

(54) METHOD AND SYSTEM FOR PROVIDING SINGLE-PHASE EXCITATION TECHNIQUES TO A START EXCITER IN A STARTER/GENERATOR SYSTEM

(75) Inventors: Bulent Sarlioglu, Torrance, CA (US); Colin E. Huggett, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/315,051

(22) Filed: Dec. 10, 2002

(65) Prior Publication Data

US 2004/0108726 A1 Jun. 10, 2004

(51) Int. Cl.
*F02N 11/04* (2006.01)

(52) U.S. Cl. ..... 290/31; 318/721; 318/701; 322/10

(58) Field of Classification Search ..... 322/10; 290/31, 4 R, 38 R, 39, 46, 49; 318/721, 701, 318/254

See application file for complete search history.

(56) References Cited

U.S. PATENT DOCUMENTS 3,629,689 A 12/1971 Riff ..... 322/28
4,616,166 A 10/1986 Cooper et al. ..... 318/712
5,066,866 A 11/1991 Hallidy ..... 290/1
5,189,357 A 2/1993 Woodson et al. ..... 318/737
5,363,032 A * 11/1994 Hanson et al. ..... 322/10
5,428,275 A 6/1995 Carr et al. ..... 318/146
5,430,362 A 7/1995 Carr et al. ..... 318/779
5,493,201 A 2/1996 Baker ..... 322/10
5,594,322 A 1/1997 Rozman et al. ..... 322/10
5,668,457 A * 9/1997 Motamed ..... 318/606
5,920,162 A 7/1999 Hanson et al. ..... 318/254
6,462,429 B1 * 10/2002 Dhyanchand et al. ..... 290/31

* cited by examiner

*Primary Examiner*—Darren Schuberg
*Assistant Examiner*—Leda T. Pham
(74) *Attorney, Agent, or Firm*—Oral Caglar, Esq.

(57) ABSTRACT

A system and method is provided for starting a prime mover coupled to a synchronous starter/generator. The system includes an exciter converter that provides a non-fundamental only signal to a field winding of an exciter of the synchronous generator. The non-fundamental signal provides a first rotating field for the field winding of the exciter. Exciter armature windings induce an AC signal from the rotating field where at least one rectifier rectifies the induced AC signal. A field winding of a main machine provides a flux from the rectified signal of the at least one rectifier. Armature windings of the main machine receive an AC signal via a main machine converter.

18 Claims, 7 Drawing Sheets

METHOD AND SYSTEM FOR PROVIDING SINGLE-PHASE EXCITATION TECHNIQUES TO A START EXCITER IN A STARTER/GENERATOR SYSTEM

CROSS REFERENCES TO RELATED APPLICATIONS

Related subject matter is disclosed in a U.S. patent application Ser. No. 10/247,615 of Sarlioglu et al. entitled, "Electric Start For A Prime Mover", filed on Sep. 20, 2002, the entire contents of which is incorporated herein by reference.

FIELD OF THE INVENTION

The present invention relates generally to the start-up of prime movers in starter/generator systems, such as a gas turbine in aerospace applications. Specifically, the invention relates to a method and system for providing single-phase excitation techniques to a start exciter in a starter/generator system.

BACKGROUND OF THE INVENTION

An auxiliary power unit (APU) system is often provided on an aircraft and is operable to provide auxiliary and/or emergency power to one or more aircraft loads. In conventional APU systems, a dedicated starter motor is activated during a starting sequence to bring a gas turbine engine up to self-sustaining speed. The gas turbine engine is then accelerated to operating speed. Once this condition is reached, a brushless, synchronous generator is excited and regulated so as to produce controlled electrical power at its terminals. The same start-up scheme is also applicable to start the main engines of the aircraft using the main engine starter/generator system.

As is known in the field, an electromagnetic machine may be operated as a motor to convert electrical power into motive power. Thus, in those applications where a source of motive power is required to start an engine, such as in an APU system or main engine starter/generator system, it is possible to omit the dedicated starter motor and operate the generator as a motor during the starting sequence to accelerate the engine to a self-sustaining speed. This capability is particularly advantageous in aircraft and electric car applications where size and weight must be held to a minimum.

The use of a starter/generator in starting and generating modes in an aircraft application has been realized by utilizing an inverter operating from a battery power source. The inverter provides control of a stator current vector coupled to the exciter machine with AC excitation to provide a main machine field flux when operated in the motoring mode. In a generating mode, conventional control of the exciter field is utilized to provide appropriate power quality. In such a system, a brushless three-phase synchronous generator operates in the generating mode to convert variable-speed motive power, supplied by a prime mover, into a fixed or variable-frequency AC power. The fixed or variable-frequency power is rectified and provided over a DC link to controllable static inverters or individual loads. The inverters are operated to produce constant-frequency AC power, which is then supplied over a load bus to one or more loads. The inverters can also be operated to produce variable voltage variable frequency AC voltage to supply various loads.

Torque produced at the shaft of the main machine is proportional to the main field flux in the main machine, and to the current in the main machine stator. To minimize the inverter KVA rating, it is desirable to maximize the main field flux in the main machine. Maximizing this flux requires that the excitation voltage applied to the exciter winding be increased to very high voltages. In applications where the maximum voltage is limited by potential insulation failure in windings, or connector voltage ratings, it is desirable to maximize the main field flux in the main field of the machine while at the same time minimizing the peak single phase excitation voltage applied to the exciter field winding.

SUMMARY OF THE INVENTION

An object of the present invention is to provide a synchronous generator, which can operate in a motoring mode to start an attached prime mover, such as a gas turbine engine.

Another object of the present invention is to maximize the main field flux for a specific maximum peak voltage applied to the exciter winding of the synchronous machine.

Still another object of the present invention is to provide alternate excitation waveforms other than a fundamental only signal to the exciter field winding of the synchronous generator.

These and other objects are substantially achieved by providing a system and method for starting a prime mover coupled to a synchronous starter/generator. The system comprises an exciter converter that provides a non-fundamental only or non-fundamental only synthesized signal using Pulse Width Modulation to a field winding of an exciter machine. The non-fundamental or non-fundamental only synthesized signal using Pulse Width Modulation provides a first rotating field for the field winding of the exciter. Exciter armature windings induce an AC signal from the rotating field where at least one rectifier rectifies the induced AC signal. A field winding of a main machine provides a flux signal from the rectified signal of said at least one rectifier. Armature windings of the main machine receive an AC signal via a main machine converter.

BRIEF DESCRIPTION OF DRAWINGS

The details of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF THE PREFERRED EMBODIMENTS

Figure 1:
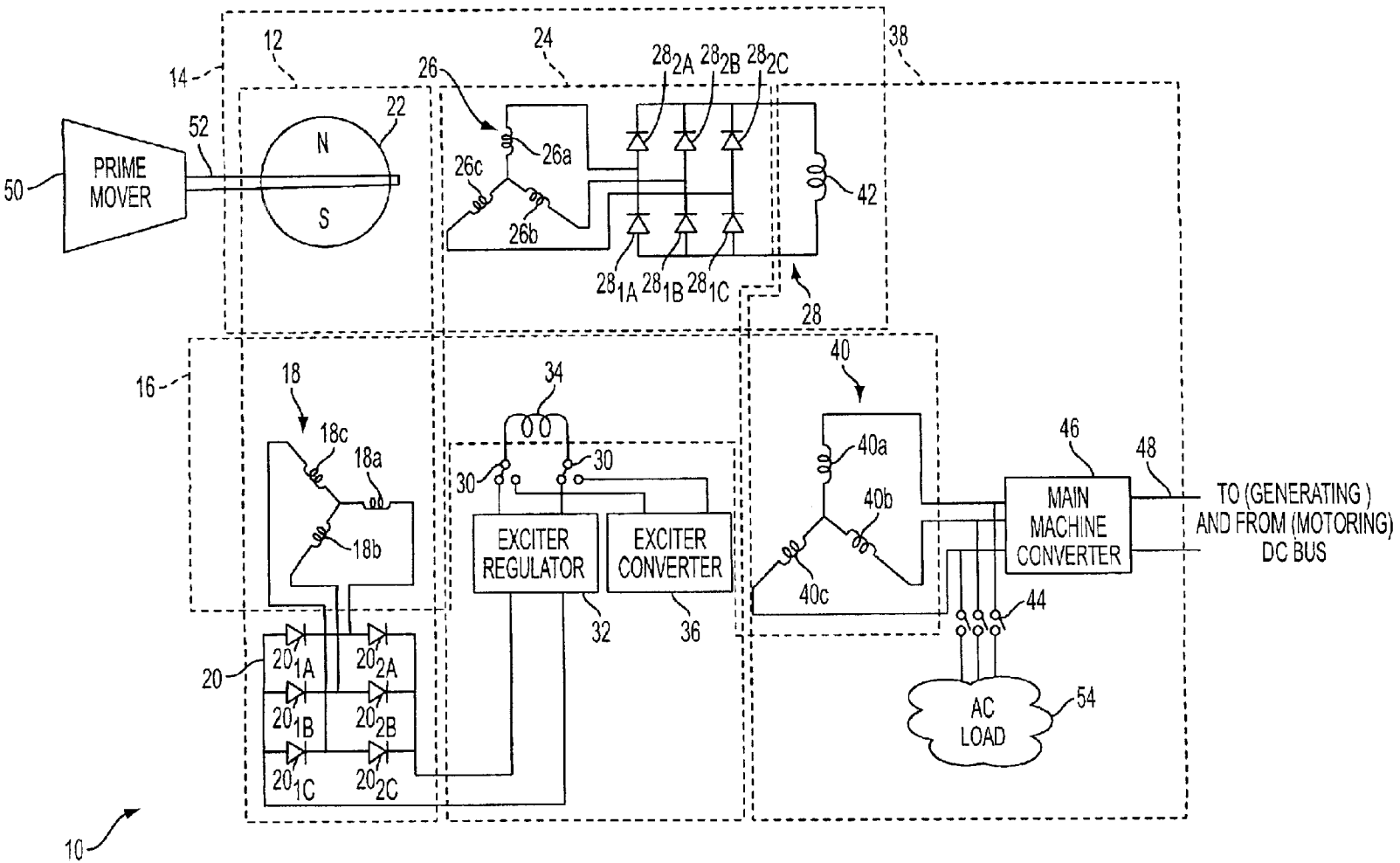
FIG. 1 is a block diagram illustrating an example of a brushless, synchronous starter/generator in accordance with an embodiment of the present invention.

FIG. 1 is an example of a brushless, synchronous starter/generator 10 in accordance with an embodiment of the present invention. The synchronous generator comprises, a permanent magnet generator (PMG) 12, a rotor shaft 14, a stator 16, PMG armature windings 18, PMG diode bridge rectifier 20 including upper leg diodes $\mathbf{20}_{1A}$ and $\mathbf{20}_{2A}$, middle leg diodes $\mathbf{20}_{1B}$ and $\mathbf{20}_{2B}$, lower leg diodes $\mathbf{20}_{1C}$ and $\mathbf{20}_{2C}$, a permanent magnet 22, an exciter salient-pole synchronous machine 24 (hereinafter exciter 24), exciter armature windings 26, exciter rotating diode bridge rectifier 28 including left leg diodes $\mathbf{28}_{1A}$ and $\mathbf{28}_{2A}$, middle leg diodes $\mathbf{28}_{1B}$ and $\mathbf{28}_{2B}$, right leg diodes $\mathbf{28}_{1C}$ and $\mathbf{28}_{2C}$, exciter contacts 30, an exciter regulator 32, exciter field winding 34, an exciter converter 36, a main salient-pole synchronous machine 38 (hereinafter main machine 38), main machine armature windings 40, a main machine field winding 42, main machine contacts 44, a main machine converter 46, and a DC bus 48. The generator 10 further includes a shaft 52 coupled between the rotor shaft 14 and a prime mover 50. In an embodiment of the present invention, the combination of the generator 10 and prime mover 50 can comprise an aircraft auxiliary power unit (APU) or main engine starter/generator. However, the generator 10 can be used in other applications such as electric cars, trains and the like without departing from the scope of the present invention.

As shown in FIG. 1, the permanent magnet 22, exciter armature winding 26, rotating diode bridge rectifier 28, and the main machine field winding 42 are disposed on the rotor shaft 14. Similarly, the PMG armature windings 18, exciter field winding 34, and main machine armature windings 40 are disposed on the stator 16.

The PMG 12 includes the permanent magnet 22 connected to the rotor shaft 14. Each one of the PMG armature windings 18*a*, 18*b* and 18*c* is coupled to a respective leg of the PMG diode bridge rectifier 20. The PMG diode bridge rectifier 20 interacts with the exciter 24 during the generating mode of operation. The exciter 24 comprises an exciter regulator 32 that is coupled to the PMG diode bridge rectifier 20. The exciter regulator 32 is a DC to DC converter used during the generating mode of operation. A set of exciter contacts 30 either connects the exciter field winding 34 to the exciter regulator 32 for generating or to the exciter converter 36 for motoring. The exciter converter 36 is an AC to DC converter used during the motoring mode of operation for the start-up of the engine. The exciter 24 also comprises the exciter armature windings 26*a*, 26*b* and 26*c* where each one of the windings is connected to a respective leg of the exciter rotating diode bridge rectifier 28. The exciter rotating diode bridge rectifier 28 is in turn electrically coupled to the main machine 38. Specifically, the exciter rotating diode bridge rectifier 28 is coupled to the main machine field winding 42.

The main machine 38 further comprises the main machine armature windings 40*a*, 40*b* and 40*c* that are each connected to the main machine converter 46. The DC bus 48 is coupled to the main machine converter 46. The main machine contacts 44 selectively couple an AC load 54 to each of the main machine armature windings 40*a*, 40*b* and 40*c*.

In an embodiment of the present invention, during the generation mode, when the shaft 52 rotates, the rotor shaft 14 which is coupled to the prime mover shaft 52 rotates in the same direction. The permanent magnet 22 rotates in the same direction as the rotor shaft 14 and provides a magnetic flux to the PMG armature windings 18, which produces voltage in the PMG armature windings 18.

The power provided from the PMG armature windings 18 is rectified by the PMG diode bridge rectifier 20 and converted to a rectified DC voltage. The rectified DC voltage is then provided to the exciter regulator 32, which is preferably a DC to DC regulator or converter and regulates the voltage of the rectified DC voltage. The regulated DC voltage is provided to the exciter field winding 34 via a set of contacts 30. An AC voltage is produced in the exciter armature windings 26 and then rectified by the exciter rotating diode bridge rectifier 28.

A DC signal is provided by the exciter rotating diode bridge rectifier 28 and then applied to the main machine field winding 42. Rotation of the rotor shaft 14 and the field winding 42 induces a three-phase AC voltage in the main machine armature windings 40. The three-phase AC voltage is provided to the AC bus for further use by AC and DC loads. The DC bus 48 provides a DC voltage to the main machine converter 46 when the starter/generator 10 is in a motoring mode.

As discussed previously, it is often necessary to bring the prime mover 50 to a self-sustaining speed. In an embodiment of the present invention, the exciter 24 and the main machine 38 are used to bring the prime mover 50 to a self-sustaining speed. Specifically, the exciter converter 36 provides a signal to the exciter field winding 34 via the contacts 30. The signal is preferably an AC voltage and provides a rotating field, which induces an AC voltage in the exciter armature windings 26. The exciter rotating diode bridge rectifier 28 converts the AC voltage received from the exciter armature windings 26 to a DC voltage and provides the DC signal to the main machine field winding 42.

The main machine converter receives a DC voltage via the dc bus 48. The DC voltage from the DC bus 48 is then converted to an AC voltage by the main machine converter 46. The main machine converter 46 provides the AC voltage to the main machine armature windings 40. The combination of a DC field, also known as flux, provided by the DC voltage on the main machine field winding 42 and the rotating field provided by the AC voltage on the main machine armature windings provides torque to the shaft 52 of the prime mover 50.

It should be noted that the signal applied to the exciter field winding 34 in a motoring mode, can be specified to be limited to a certain peak voltage value e.g., about 484 volts rms or 684 volts peak, which is much higher than when the machine is in the generating mode. Since the exciter field winding 34 is designed for DC voltage and a generating mode of operation, the exciter field winding 34 inherently has a high inductance due to the required large number of turns for the exciter 34. The high inductance of the field winding of the exciter machine requires high voltages when excited with AC voltage during the motoring operation. The peak of the AC voltage applied is a design constraint.

Flux induced in the air gap (not shown) of the rotor shaft 14 for the exciter 24 is equal to the volt-seconds integral of applied voltage to the field 16 of the exciter 24 per Faraday's law of induction. Higher flux levels for the same peak voltage are achieved by applying signals other than a conventional fundamental only signal to the exciter field winding 34 via the exciter converter 36. The fundamental only signal is a sinusoidal signal.

In a first embodiment of the invention, the peak of the excitation voltage is reduced by preferably providing a fundamental plus third harmonic signal to the exciter field winding 34 via the exciter converter 36 for obtaining the same amount of main field current. In this embodiment, a fundamental plus third harmonic signal can be synthesized preferably using a modulation technique such as Pulse Width Modulation (PWM). A low pass filter is preferably used to obtain the fundamental plus third harmonic voltages. The filter is preferably placed in the same box as the exciter converter 36, so that the inter-connect wires (not shown) will not radiate electromagnetic interference. It should be appreciated by those skilled in the art that although the invention is described as using the third harmonic, other levels of harmonics can be used without departing from the scope of the present invention.

The improvement between applying a fundamental plus third harmonic signal to the exciter field winding 34 compared to applying a conventional fundamental only signal to the exciter field winding 34 is significant. As a result, the DC current provided to the main motor field winding 42 increases significantly using the fundamental plus harmonic signal.

The difference in current levels between the conventional fundamental only signal and the fundamental plus third harmonic signal is shown in Table 1. Specifically, Table 1 shows the results of the comparison in voltage and current levels between the two signals.

TABLE 1

| | FUNDAMENTAL ONLY | | | | FUNDAMENTAL + THIRD HARMONIC | | | | |
|---|---|---|---|---|---|---|---|---|---|
| RPM | $V_{fund\ rms}$ (V) | $V_{3rd\ rms}$ (V) | $V_{peak}$ (V) | $I_{dc1}$ (A) | $V_{fund}$ (V) | $V_{3rd}$ (V) | $V_{peak}$ (V) | $I_{dc2}$ (A) | % $I_{dc2}/I_{dc1}$ (A) |
| 100 | 483.6 | 0 | 683.9 | 22.6 | 512.9 | 170.98 | 683.9 | 27.2 | 120.35 |
| 500 | 483.6 | 0 | 683.9 | 22.6 | 512.9 | 170.98 | 683.9 | 27.1 | 120 |
| 1000 | 483.6 | 0 | 683.9 | 22.4 | 512.9 | 170.98 | 683.9 | 26.6 | 118.75 |
| 2000 | 483.6 | 0 | 683.9 | 21.4 | 512.9 | 170.98 | 683.9 | 25.4 | 118.7 |
| 3000 | 483.6 | 0 | 683.9 | 23 | 512.9 | 170.98 | 683.9 | 25.5 | 110.8 |
| 4000 | 483.6 | 0 | 683.9 | 24.7 | 512.9 | 170.98 | 683.9 | 26.3 | 106.5 |

Between 100 and 2000 rpm, the current at the main machine field winding 42 is about 19% greater using the fundamental plus third harmonic signal compared to the fundamental only signal.

At 1000 rpm, the current at the main machine field winding 42 is 22.4 when the fundamental only signal is applied to the exciter field winding 34, and 26.6 when the fundamental plus harmonic signal is applied to the exciter field winding 34. This is an improvement of about 19%.

At 2000 rpm, the current at the main machine field winding 42 is 21.4 when the fundamental only signal is applied to the exciter field winding 34, and 25.4 when the fundamental plus harmonic signal is applied to the exciter field winding 34. This is an improvement of about 19%.

At 3000 rpm, the current at the main machine field winding 42 is 23 when the fundamental only signal is applied to the exciter field winding 34, and 25.5 when the fundamental plus harmonic signal is applied to the exciter field winding 34. This is an improvement of about 11%.

At 4000 rpm, the current at the main machine field winding 42 is 24.7 when the fundamental only signal is applied to the exciter field winding 34, and 26.3 when the fundamental plus harmonic signal is applied to the exciter field winding 34. This is an improvement of about 6%.

In a second embodiment of the invention, the required peak value of excitation voltage is reduced by preferably providing a square wave signal to the exciter field winding 34 via the exciter converter 36. This embodiment significantly reduces the switching losses of the exciter converter 36, as well as the cooling requirements, since there are no notches in the output voltage waveform of the converter. Also, the requirement for an output filter is eliminated. However, the elimination of the filter causes the interconnect wires between the exciter converter 36 and the field winding 34 of the main machine to radiate electro-magnetic interference unless the connecting cable is shielded with an over-braid. Square wave excitation therefore preferably includes shielding of the interconnect wiring. This embodiment of the invention is the preferable embodiment to minimize the weight, size, and cost of the starter/generator system 10 and to minimize the peak value of the AC voltage applied to the exciter converter 36. The application of a square wave signal to the exciter field winding 34 provides a significant improvement over both the fundamental signal and the fundamental plus third harmonic signal. The difference in current levels between the conventional fundamental signal and the square wave signal is shown in Table 2. About a 60% improvement in current levels can be achieved between 100 and 2000 rpm at the main machine field winding 42 when a square wave signal is applied to the exciter field winding 34 compared to a fundamental only signal.

TABLE 2

| | FUNDAMENTAL ONLY | | | | SQUARE WAVE | | |
|---|---|---|---|---|---|---|---|
| RPM | $V_{fund\ rms}$ (V) | $V_{3rd\ rms}$ (V) | $V_{peak}$ (V) | $I_{dc1}$ (A) | $V_{peak}$ (V) | $I_{dc2}$ (A) | % $I_{dc2/Idc1}$ (A) |
| 100 | 483.6 | 0 | 683.9 | 22.6 | 683.9 | 37 | 163.7 |
| 500 | 483.6 | 0 | 683.9 | 22.6 | 683.9 | 36.9 | 163.3 |
| 1000 | 483.6 | 0 | 683.9 | 22.4 | 683.9 | 36.2 | 161.6 |
| 2000 | 483.6 | 0 | 683.9 | 21.4 | 683.9 | 34.4 | 160.7 |
| 3000 | 483.6 | 0 | 683.9 | 23 | 683.9 | 33.6 | 146.1 |
| 4000 | 483.6 | 0 | 683.9 | 24.7 | 683.9 | 32.8 | 132.8 |

At 100 rpm, the current at the main machine field winding 42 is 22.6 when the fundamental only signal is applied to the exciter field winding 34, and 37 when the square wave signal is applied to the exciter field winding 34. This is an improvement of about 64%.

At 500 rpm, the current at the main machine field winding 42 is 22.6 when the fundamental only signal is applied to the exciter field winding 34, and 36.9 when the square wave signal is applied to the exciter field winding 34. This is an improvement of about 63%.

At 1000 rpm, the current at the main machine field winding 42 is 22.4 when the fundamental only signal is applied to the exciter field winding 34, and 36.2 when the square wave signal is applied to the exciter field winding 34. This is an improvement of about 62%.

At 2000 rpm, the current at the main machine field winding 42 is 21.4 when the fundamental only signal is applied to the exciter field winding 34, and 34.4 when the square wave signal is applied to the exciter field winding 34. This is an improvement of about 61%.

At 3000 rpm, the current at the main machine field winding 42 is 23 when the fundamental only signal is applied to the exciter field winding 34, and 33.6 when the square wave signal is applied to the exciter field winding 34. This is an improvement of about 46%.

At 4000 rpm, the current at the main machine field winding 42 is 24.7 when the fundamental only signal is applied to the exciter field winding 34, and 32.8 when the square wave signal is applied to the exciter field winding 34. This is an improvement of about 33%.

The fundamental only section of Table 1 and Table 2 show that $I_{dc1}$ is nearly constant for the different rpms of the prime mover 50 up to about 3,000 rpms. A constant $I_{dc1}$ provides a constant torque for the prime mover 50. Similarly, $I_{dc2}$ for the fundamental plus third harmonic and the square wave signals provides a constant torque for the prime mover 50 up to about 3,000 rpms. However, using the same peak voltage of 683.9 or 684 volts, a modest increase, about 16%, in current can be realized applying the fundamental plus third harmonic signal to the exciter field winding 34 and a substantial increase, about 60%, in current can be realized by applying a square wave signal to the exciter field winding 34.

In order to maintain a constant torque above 4,000 rpm, a gearbox (not shown) can be provided between the prime mover 50 and the generator. At rpms above 4,000, diminishing returns are provided with reference to $I_{dc2}$. In other words, the percent increase between $I_{dc1}$ and $I_{dc2}$ decreases significantly at rpms above 4,000 for both the fundamental plus third harmonic signal and the square wave signal.

Figure 2A:
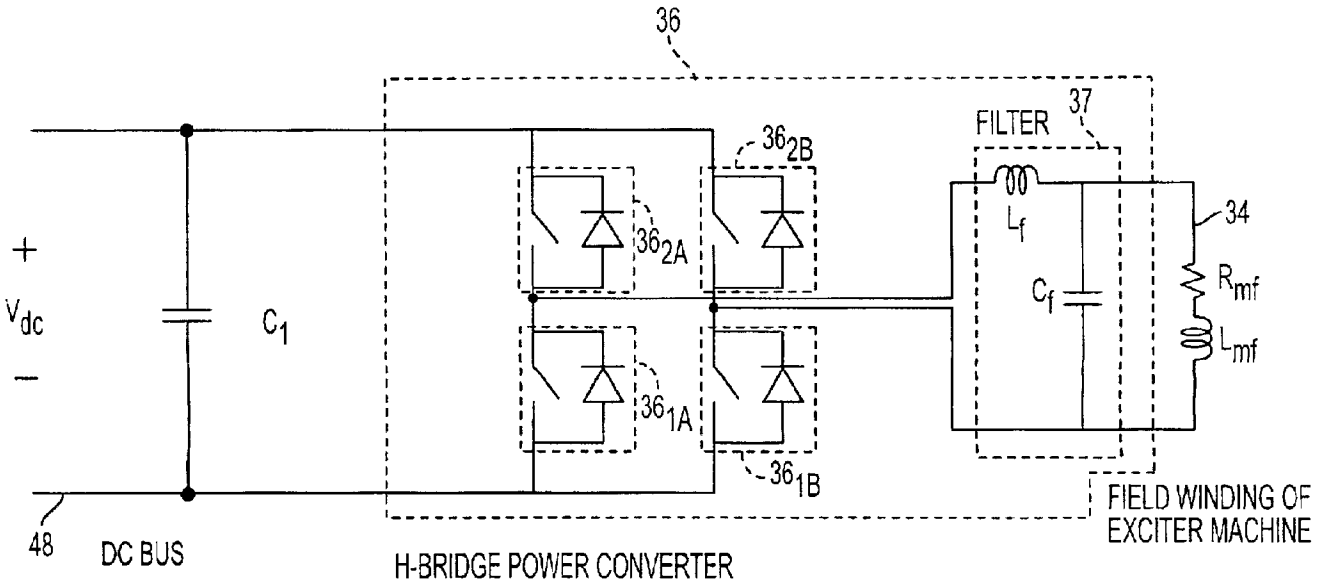
FIG. 2A is a detailed schematic illustrating an example of a circuit for providing a fundamental plus third harmonic voltage to excite a field winding of an exciter machine in accordance with an embodiment of the present invention.

FIG. 2A is a detailed schematic illustrating an example of a circuit for providing a fundamental plus third harmonic voltage to excite the field winding of the exciter machine 24 in accordance with an embodiment of the present invention. Specifically, FIG. 2A comprises the DC bus 48, a capacitor $C_1$, an exciter converter 36 including left leg diode and switches $\mathbf{36}_{1A}$ and $\mathbf{36}_{2A}$ and right leg diode and switches $\mathbf{36}_{1B}$ and $\mathbf{36}_{2B}$, a filter 37 including inductance $L_f$ and capacitance $C_f$ and the exciter field winding 34 including a resistance $R_{mf}$ and an inductance $L_{mf}$. The circuit of FIG. 2A provides a fundamental plus third harmonic synthesized voltage using pulse width modulation (PWM) to the exciter field winding 34. That is, a reference fundamental plus third harmonic voltage is compared to preferably a triangular waveform voltage. The exciter converter 36 which is preferably an H-bridge power converter is used to synthesize the reference voltage by turning diagonal pairs of diodes and switches e.g., $\mathbf{36}_{1A}$ and $\mathbf{36}_{2B}$ and/or $\mathbf{36}_{1B}$ and $\mathbf{36}_{2A}$ on and off. Filter 37, which is preferably a low pass filter, is used to filter out the pulse width modulated voltage. The synthesized voltage is then applied to the exciter field winding 34.

Figure 2B:
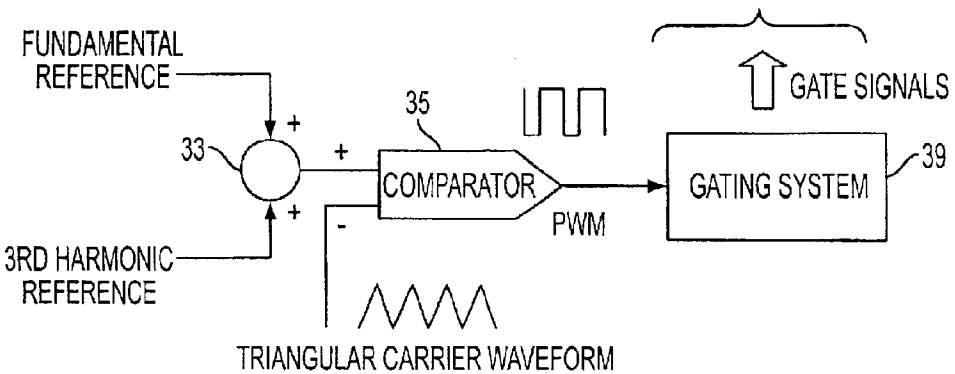
FIG. 2B is a detailed block diagram illustrating an example of an exciter converter control and gating circuit for providing a fundamental plus third harmonic voltage to excite a field winding of an exciter machine in accordance with an embodiment of the present invention.

FIG. 2B is a detailed block diagram illustrating an example of an exciter converter control and gating circuit 36 for providing a fundamental plus third harmonic voltage to excite a field winding of an exciter machine in accordance with an embodiment of the present invention. The exciter converter 36 comprises a summing element 33 for providing a single reference signal from the fundamental reference signal and the third harmonic reference signal. The single reference signal is a fundamental plus third harmonic reference signal. A comparator 35 compares the fundamental plus third harmonic reference signal to a triangular carrier waveform. The output signal from the comparator 35 is a PWM signal. The PWM signal is provided to a gating system 39, which determines which one of the diagonal pairs of diodes and switches $\mathbf{36}_{1A}$ and $\mathbf{36}_{2B}$ and $\mathbf{36}_{1B}$ and $\mathbf{36}_{2A}$ will be turned on and off.

Figure 2C:
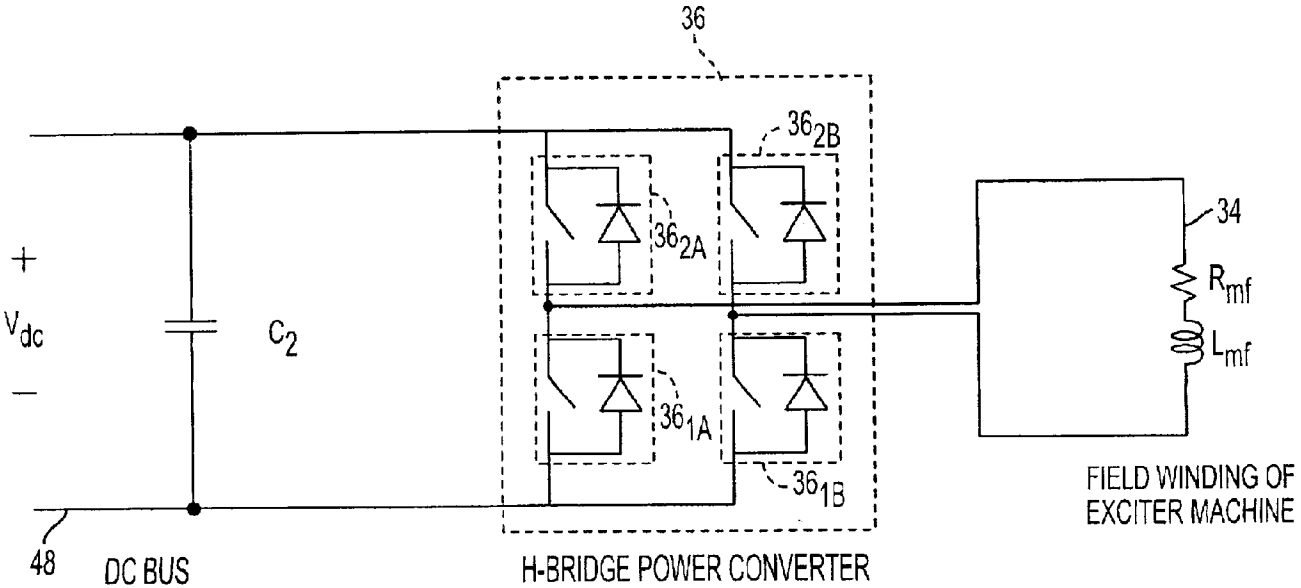
FIG. 2C is a detailed schematic illustrating an example of a circuit for providing a square wave voltage to excite the field winding of the exciter machine in accordance with an embodiment of the present invention.
Figure 2D:
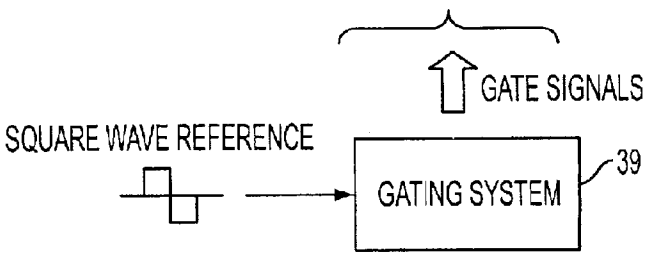
FIG. 2D is a detailed block diagram illustrating an example of an exciter converter control and gating circuit for providing a square wave voltage to excite the field winding of the exciter machine in accordance with an embodiment of the present invention.

FIG. 2C is a detailed schematic illustrating an example of a circuit for providing a square wave voltage to excite the field winding of the exciter machine 24 in accordance with an embodiment of the present invention. FIG. 2B comprises the DC bus 48, a capacitor $C_2$, the exciter converter 36 including left leg diode and switches $\mathbf{36}_{1A}$ and $\mathbf{36}_{2A}$ and right leg diode and switches $\mathbf{36}_{1B}$ and $\mathbf{36}_{2B}$, and the exciter field winding 34 including the resistance $R_{mf}$ and an inductance $L_{mf}$. Pulse width modulation is not performed. Rather, the exciter converter 36 is used to provide an output voltage by turning the diagonal pairs of diodes and switches e.g., $\mathbf{36}_{1A}$ and $\mathbf{36}_{2B}$ and/or $\mathbf{36}_{1B}$ and $\mathbf{36}_{2A}$ on and off. A filter is not needed since there is no need to filter out any PWM waveforms. However, to prevent radiated electro-magnetic interference, a shielded connecting cable with an over-braid should preferably be used between the exciter converter 36 and the field winding 34 of the main machine. In addition, switching losses for the exciter converter 36 is less than with the embodiment of the invention using the fundamental plus third harmonic voltage. Furthermore, since switching losses are less, the need for cooling the exciter converter 36 is reduced.

The gating system 39 of FIG. 2C receives the square wave reference signal and provides gating signals which power the diagonal pairs of diodes and switches $\mathbf{36}_{1A}$ and $\mathbf{36}_{2B}$ and $\mathbf{36}_{1B}$ and $\mathbf{36}_{2A}$ on and off.

Figure 3:
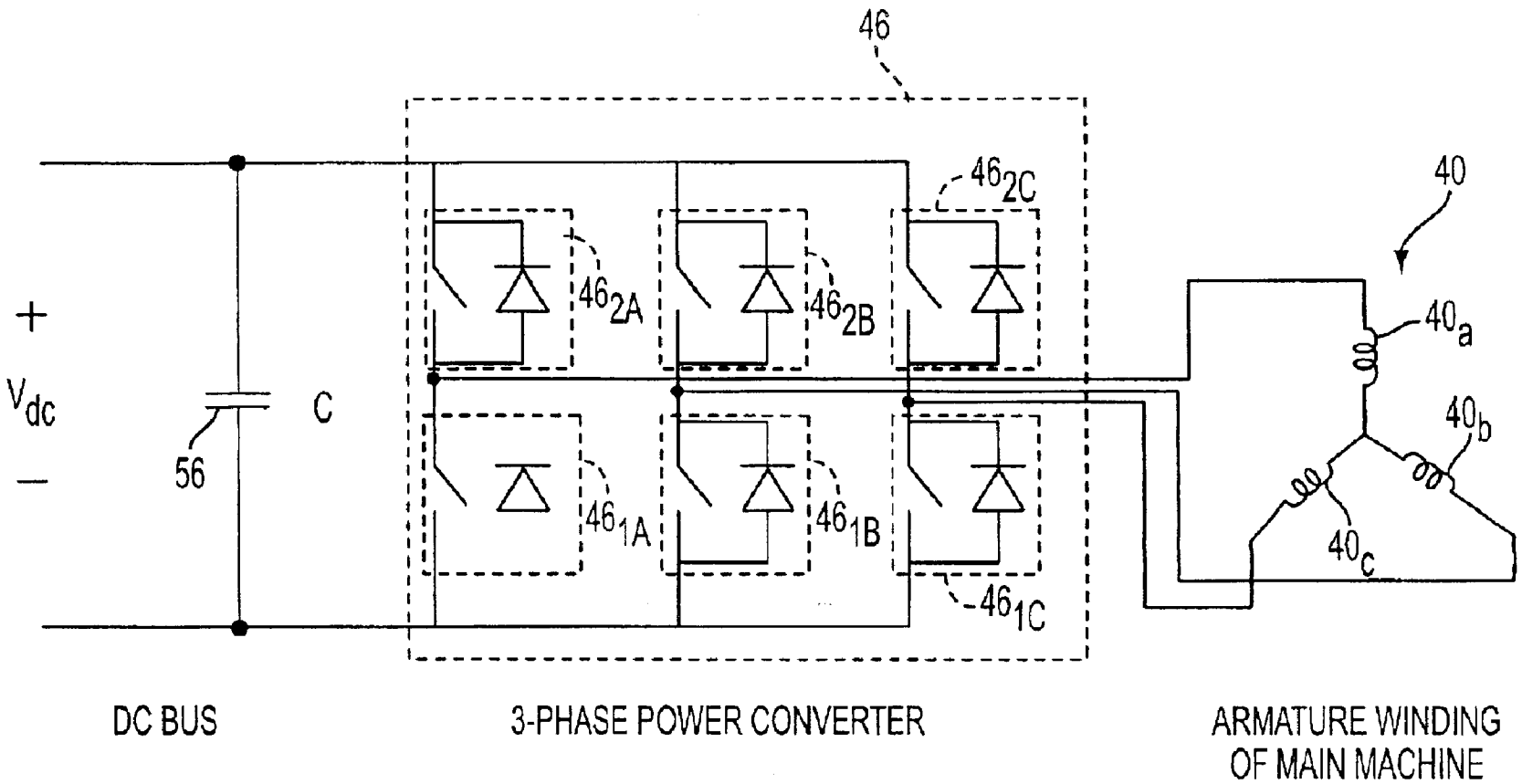
FIG. 3 is a detailed block diagram illustrating an example of a circuit for armature excitation of a main machine in accordance with an embodiment of the present invention.

FIG. 3 is a detailed block diagram illustrating an example of armature excitation for a main machine in accordance with an embodiment of the present invention. Specifically, FIG. 3 comprises a capacitor 56, the DC bus 48, the main machine converter 46, and the main machine armature windings 40. The main machine converter 46 further comprises left leg diodes and switches $\mathbf{46}_{1A}$ and $\mathbf{46}_{2A}$, middle leg diodes and switches $\mathbf{46}_{1B}$ and $\mathbf{46}_{2B}$, right leg diodes and switches $\mathbf{46}_{1C}$ and $\mathbf{46}_{2C}$ It should be noted that the diodes are inherent in the switches for the main machine converter 46.

The invention of FIG. 3 operates in the following manner. A DC voltage is provided over the DC bus 48 to the capacitor 56. Capacitor 56 serves as a filter to smooth out the DC voltage. The smoothed DC voltage is provided to the main machine converter 46. The switches of the main machine converter 46 are modulated to provide an AC voltage from the smoothed DC voltage. The AC voltage is then provided to the main machine armature windings 40.

Figure 4:
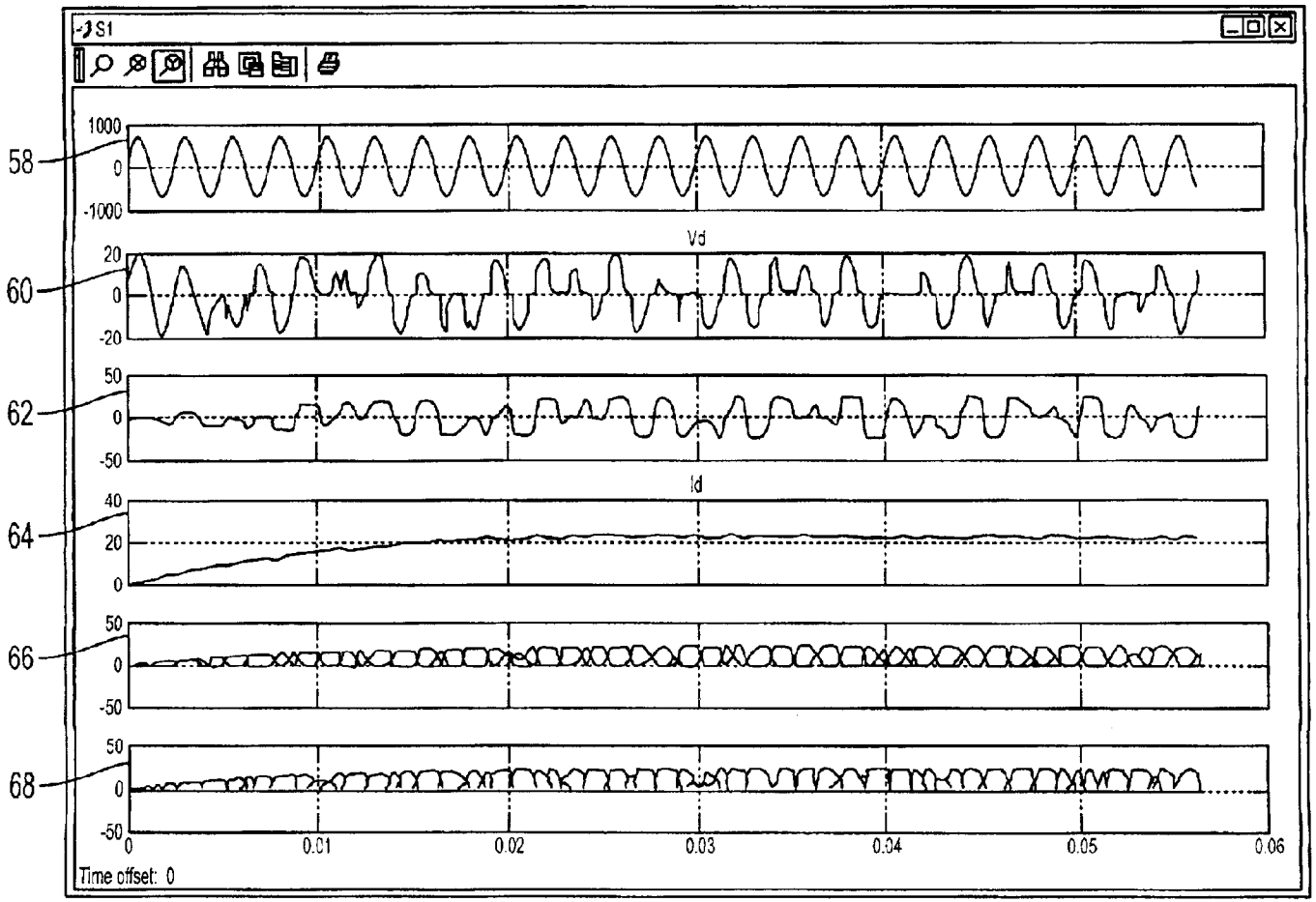
FIG. 4 shows excitation simulation results using a conventional waveform.

FIG. 4 shows excitation simulation results using a conventional fundamental only waveform. The fundamental only waveform 58 is about 484 rms volts at 400 Hz and is provided to the exciter field winding 34 via a conventional start generator (not shown) when the shaft 14 is rotating at 1,000 rpms. Waveform 58 is for AC voltage applied to the field winding of the exciter machine. Waveform 60 is one of the line to line AC voltages at the exciter armature windings 26. Waveform 62 is the AC current going to one of the legs of the exciter rotating diode bridge rectifier 28. Waveform 64 is the DC current in the main machine field winding 42 and is about 22.4 amps. Waveform 66 is the upper diode $\mathbf{28}_{2A}$, $\mathbf{28}_{2B}$, and $\mathbf{28}_{2C}$ currents for the rotating diode bridge rectifier. Waveform 68 is the lower diode $\mathbf{28}_{1A}$, $\mathbf{28}_{1B}$, and $\mathbf{28}_{1C}$ currents for the rotating diode bridge rectifier.

Figure 5:
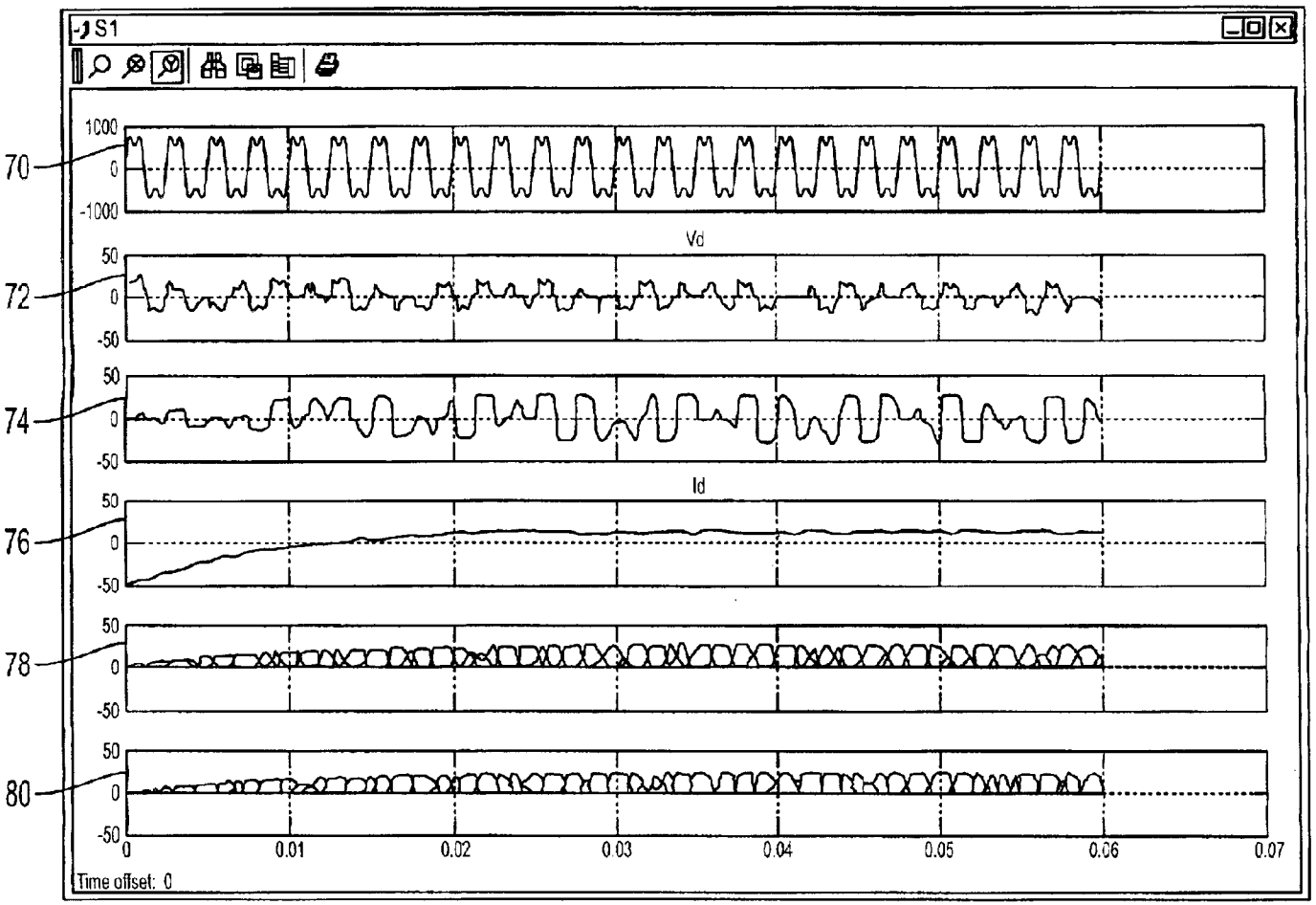
FIG. 5 shows excitation simulation results using a fundamental plus third harmonic waveform in accordance with an embodiment of the present invention.

FIG. 5 shows excitation simulation results using a fundamental plus third harmonic waveform in accordance with an embodiment of the present invention. The fundamental plus harmonic waveform 70 is about 512.9 volts rms for the fundamental signal at 400 Hz and 171 volts rms for the $3^{rd}$ harmonic signal and is provided to the exciter field winding 34 via the exciter converter 36 when the shaft 14 is rotating at 1,000 rpms. Waveform 70 is for AC voltage applied to the field winding of the exciter machine. Waveform 72 is one of the line to line AC voltages at the exciter armature windings 26. Waveform 74 is the AC current going to one of the legs of the exciter rotating diode bridge rectifier 28. Waveform 76 is the DC current in the main machine field winding 42 and is about 26.6 amps, which is an improvement over the current for the fundamental only waveform. Waveform 78 is the upper diode $\mathbf{28}_{2A}$, $\mathbf{28}_{2B}$, and $\mathbf{28}_{2C}$ currents for the rotating diode bridge rectifier. Waveform 80 is the lower diode $\mathbf{28}_{1A}$, $\mathbf{28}_{1B}$, and $\mathbf{28}_{1C}$ currents for the rotating diode bridge rectifier.

Figure 6:
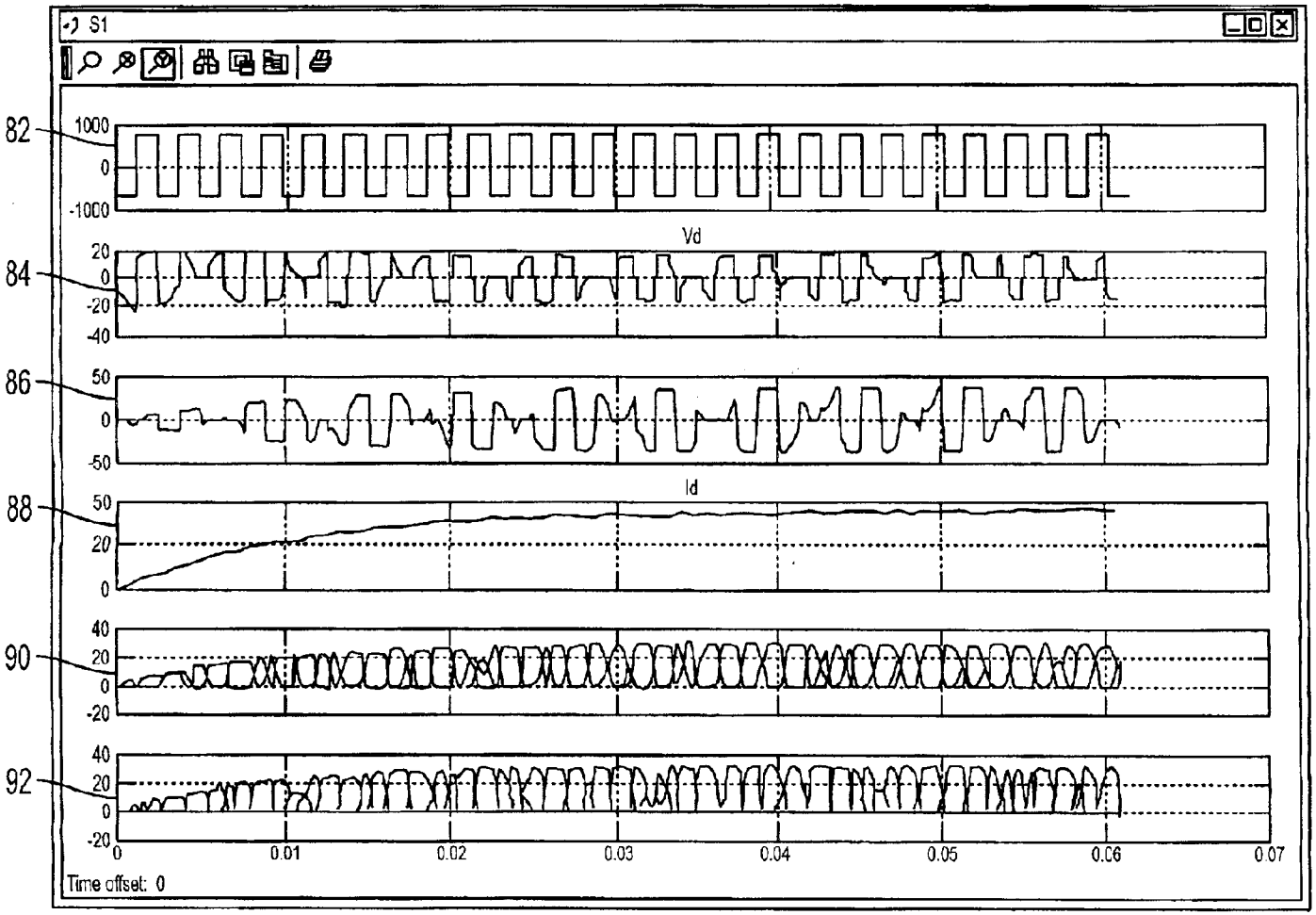
FIG. 6 shows excitation simulation results using a square waveform in accordance with an embodiment of the present invention.

FIG. 6 shows excitation simulation results using a square waveform in accordance with an embodiment of the present invention. The square waveform 82 is about 683.9 volts rms at 400 Hz. The square waveform 82 is provided to the exciter field winding 34 via the exciter converter 36 when the shaft 14 is rotating at 1,000 rpms. Waveform 82 is for AC voltage applied to the field winding of the exciter machine. Waveform 84 is one of the line to line AC voltages at the exciter armature windings 26. Waveform 86 is the AC current going to one of the legs of the exciter rotating diode bridge rectifier 28. Waveform 88 is the DC current in the main machine field winding 42 and is about 36.2 amps, which is a significant improvement over the current for the fundamental only waveform. Waveform 90 is the upper diode $\mathbf{28}_{2A}$, $\mathbf{28}_{2B}$, and $\mathbf{28}_{2C}$ currents for the rotating diode bridge rectifier. Waveform 92 is the lower diode $\mathbf{28}_{1A}$, $\mathbf{28}_{1B}$, and $\mathbf{28}_{1C}$ currents for the rotating diode bridge rectifier.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and following claims.

What is claimed is:

1. A method of starting a prime mover coupled to a synchronous starter/generator, said method comprising:

providing a first rotating field for an exciter of said generator by applying a first AC signal comprising a square wave signal or a fundamental signal and at least one harmonic to an exciter field winding via an exciter generator to provide higher torque at the start up of the prime mover;

applying said rotating field to armature windings of said exciter, said rotating field inducing a three phase signal in said armature windings of said exciter;

rectifying said three phase signal using at least one rectifier;

providing said rectified signal to a field winding of a main machine, said rectified signal providing flux around said field winding; and providing a second AC signal to armature windings of said main machine.

2. The method of claim 1, wherein said flux and said AC signal on said armature windings of said main machine provides a second rotating field.

3. The method of claim 2, wherein said second rotating field provides torque to the shaft of said prime mover.

4. The method of claim 1, wherein said at least one rectifier comprises a rotating diode bridge rectifier having at least one leg.

5. The method of claim 1, said prime mover and said synchronous starter/generator are used to start a main engine.

6. The method of claim 1, wherein said prime mover comprises at least one of a gas turbine engine, a diesel engine, and a gas engine.

7. The method of claim 1, wherein said prime mover and said synchronous generator comprise an auxiliary power unit (APU).

8. The method of claim 1, wherein said rectified signal comprises a DC signal.

9. An apparatus for starting a prime mover, comprising:

a synchronous starter/generator;

an exciter converter, adapted to provide a first AC signal comprising a square wave signal or a fundamental signal and at least one harmonic to a field winding of an exciter of said synchronous generator to provide higher torque at the start up of the prime mover, said first AC signal providing a first rotating field for said field winding of said exciter;

exciter armature windings, adapted to induce an AC signal from said rotating field;

at least one rectifier, adapted to rectify said induced AC signal;

a field winding of a main machine, adapted to provide a flux signal from said rectified signal of said at least one rectifier; and armature windings of said main machine, adapted to receive a second AC signal.

10. The apparatus of claim 9, wherein said flux and said AC signal on said armature windings of said main machine provides a second rotating field.

11. The apparatus of claim 10, wherein said second rotating field provides torque to the shaft of said prime mover.

12. The apparatus of claim 9, wherein said at least one rectifier comprises a rotating diode bridge rectifier having at least one leg.

13. The apparatus of claim 9, wherein said prime mover and said synchronous generator comprise a main engine starter.

14. The apparatus of claim 9, wherein said prime mover comprises at least one of a gas turbine engine, a diesel engine, and a gas engine.

15. The apparatus of claim 9, wherein said prime mover and said synchronous generator comprise an auxiliary power unit (APU).

16. The apparatus of claim 9, wherein said rectified signal comprises a DC signal.

17. The apparatus of claim 9, wherein said non-fundamental only signal comprises a single phase signal.

18. An apparatus for starting a prime mover, comprising:

a synchronous starter/generator;

an exciter converter, adapted to provide a fundamental signal and a third harmonic signal via pulse width modulation to a field winding of an exciter of said synchronous generator in order to provide higher torque at the start up of the prime mover, said fundamental signal and third harmonic signal providing a first rotating field for said field winding of said exciter;

exciter armature windings, adapted to induce an AC signal from said rotating field;

at least one rectifier, adapted to rectify said induced AC signal;

a field winding of a main machine, adapted to provide a flux signal from said rectified signal of said at least one rectifier; and armature windings of said main machine, adapted to receive a second AC signal.

* * * * *